US007909632B2

(12) United States Patent
Wu

(10) Patent No.: US 7,909,632 B2
(45) Date of Patent: Mar. 22, 2011

(54) CABLE ASSEMBLY WITH LATCHING MECHANISM

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/723,780

(22) Filed: Mar. 15, 2010

(65) Prior Publication Data

US 2010/0233907 A1 Sep. 16, 2010

(51) Int. Cl.
*H01R 13/627* (2006.01)

(52) U.S. Cl. ..... 439/353; 439/607.48; 439/607.58

(58) Field of Classification Search ..... 439/353, 439/607.58, 607.47, 607.48, 626, 357, 358, 439/108, 660
See application file for complete search history.

(56) References Cited

U.S. PATENT DOCUMENTS

| | | | | |
|---|---|---|---|---|
| 7,364,465 | B2 * | 4/2008 | Wu | 439/607.55 |
| 7,534,141 | B1 * | 5/2009 | Wu | 439/607.01 |
| 7,618,264 | B2 * | 11/2009 | Wu | 439/76.1 |
| 7,618,293 | B2 * | 11/2009 | Wu | 439/660 |
| 7,625,236 | B1 * | 12/2009 | Wu | 439/607.58 |
| 7,628,638 | B2 * | 12/2009 | Wu | 439/358 |
| 7,666,023 | B2 * | 2/2010 | Wu | 439/352 |
| 7,708,600 | B2 * | 5/2010 | Wu | 439/660 |
| 2010/0015851 | A1 * | 1/2010 | Wu | 439/607.01 |
| 2010/0285684 | A1 * | 11/2010 | Zhang | 439/357 |

FOREIGN PATENT DOCUMENTS

CN 200420022197 9/2005

* cited by examiner

*Primary Examiner* — Neil Abrams
*Assistant Examiner* — Phuongchi T Nguyen
(74) *Attorney, Agent, or Firm* — Wei Te Chung; Andrew C. Cheng; Ming Chieh Chang

(57) ABSTRACT

An cable assembly includes an insulative housing with a plurality of terminals; a cable having a plurality of wires respectively connected to the plurality of terminals; a latching member mounted to the insulative housing, the latching member including two latching arms spaced apart from each other along a transversal direction and a connecting portion with two opposite ends thereof joined with the two latching arms, at least one resilient tab extend downwardly from the connecting portion; and an external cover enclosing the insulative housing and the latching member, the external cover having a deformable button disposed proximate to the connecting portion of the latching member.

19 Claims, 14 Drawing Sheets

CABLE ASSEMBLY WITH LATCHING MECHANISM

FIELD OF THE INVENTION

The present invention generally relates to a cable assembly, and more particularly to a cable assembly with a latching mechanism.

DESCRIPTION OF PRIOR ART

Nowadays, an electrical device has become lower profile and multi-functional, and a cable assembly for the electrical device is also capable of high-speed transmitting, and reliably connection and easily detachable with its counterpart.

CN patent No. 200420022197 issued to Peng on Sep. 7, 2005 discloses a cable assembly. The cable assembly includes an insulative housing, a plurality of terminals accommodated in the insulative housing, a metallic shell enclosing the insulative housing, two locking members mounted to two sides of the insulative housing and two clamping members adapted for securing the two locking members and an external cover. Each locking member has a mounting portion fixed to the insulative housing, a deformable arm connected to the mounting portion and deflected along up-to-down direction, in addition, a hook is formed at a front end of the deformable arm, and an upward protrusion is formed on the deformable arm and accessible by a deformable button which is formed on the external cover. However, it takes more time to manufacture and assemble the two clamping members to the insulative housing, and in addition, a total dimension of the insulative housing is increased.

Hence, an improved cable assembly is highly desired to overcome the aforementioned problems.

SUMMARY OF THE INVENTION

Accordingly, an object of the present invention is to provide a lower profile and easily manufactured cable assembly.

In order to achieve the object set forth, a cable assembly in accordance with the present invention comprises an insulative housing with a plurality of terminals; a cable having a plurality of wires respectively connected to the plurality of terminals; a latching member mounted to the insulative housing, the latching member including two latching arms spaced apart from each other along a transversal direction and a connecting portion with two opposite ends thereof joined with the two latching arms, at least one resilient tab extend downwardly from the connecting portion; and an external cover enclosing the insulative housing and the latching member, the external cover having a deformable button disposed proximate to the connecting portion of the latching member.

Other objects, advantages and novel features of the invention will become more apparent from the following detailed description when taken in conjunction with the accompanying drawings.

DETAILED DESCRIPTION OF PREFERRED EMBODIMENTS

Figure 1:
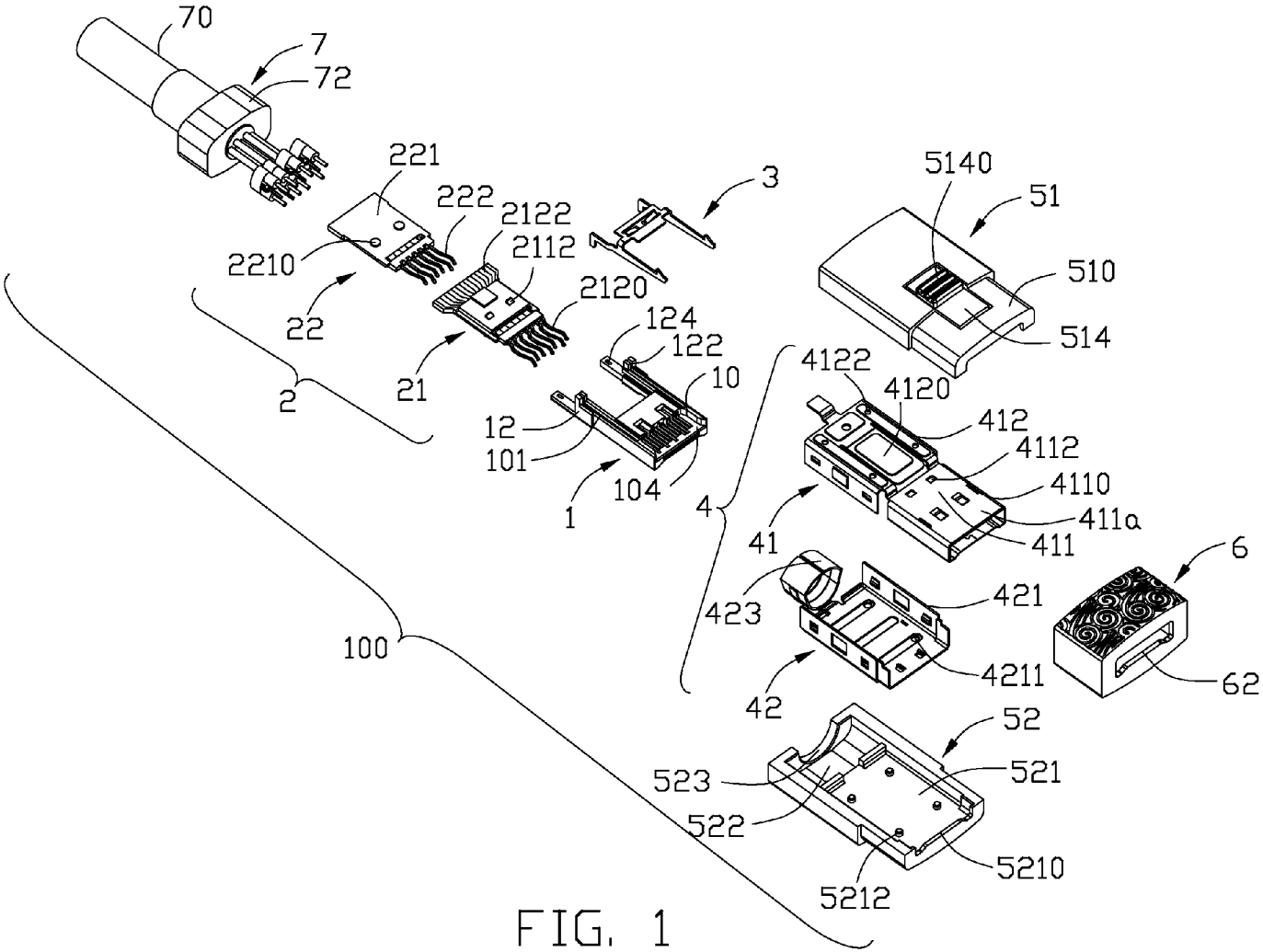
FIG. 1 is an exploded, perspective view of a cable assembly of the first embodiment in accordance with the present invention.

Reference will now be made in detail to the preferred embodiment of the present invention.

Referring to FIGS. 1-7, a cable assembly 100 of the first embodiment in accordance with the present invention comprises an insulative housing 1, a terminal module 2, a latching member 3, a metallic shell 4, an external cover 5, a cap 6 and a cable 7.

The insulative housing 1 includes a main portion 10 and two mounting arms 12 extending rearwardly from lateral sides of the main portion 10. A receiving space 102 is recessed forwardly from a middle segment of a rear edge of the main portion 10. A cavity 104 is recessed downwardly from a front segment of a top side of the main portion 10 and further communicates with the receiving space 102. A depression 104' is defined in a lower side of the main portion 10, and the depression 104' is of isosceles trapezoid shape, which has a horizontal side 1041' and two oblique sides 1041', 1042'. A slot 101 is defined in the mounting arm 12 and partial of main portion 10 in front of the mounting arm 12. A positioning hole 124 is defined in a rear portion of the mounting arm 12, and a standoff 122 is formed on middle portion of the mounting arm 12 and projected upwardly.

The terminal module 2 includes a first terminal module 21 and a second terminal module 22. The first terminal module 21 has an insulator 211 and a number of terminals 212 combined together by insert-molded process. The terminals 212 are divided into signal terminals and grounding terminals configured to be longer than the signal terminals. The terminals 212 have contacting portions 2120 disposed in front of an edge of the insulator 211 and tail portions 2121 located on a back segment of the insulator 211 and fanned out. Two mounting holes 2110 are defined in a bottom side of the insulator 211 and two protruding portions 2112 are formed on a top side of the insulator 211.

The second terminal module 22 has an insulator 221 and a number of terminals 222 combined together by insert-molded process. The terminals 222 are divided into signal terminals and grounding terminals configured to be longer than the signal terminals. The terminals 222 have contacting portions 2220 disposed in front of an edge of the insulator 221 and tail portions 2222 located on a back segment of the insulator 221 and fanned out. Two mounting posts 2210 are formed on an top side of the insulator 221.

Figure 2:
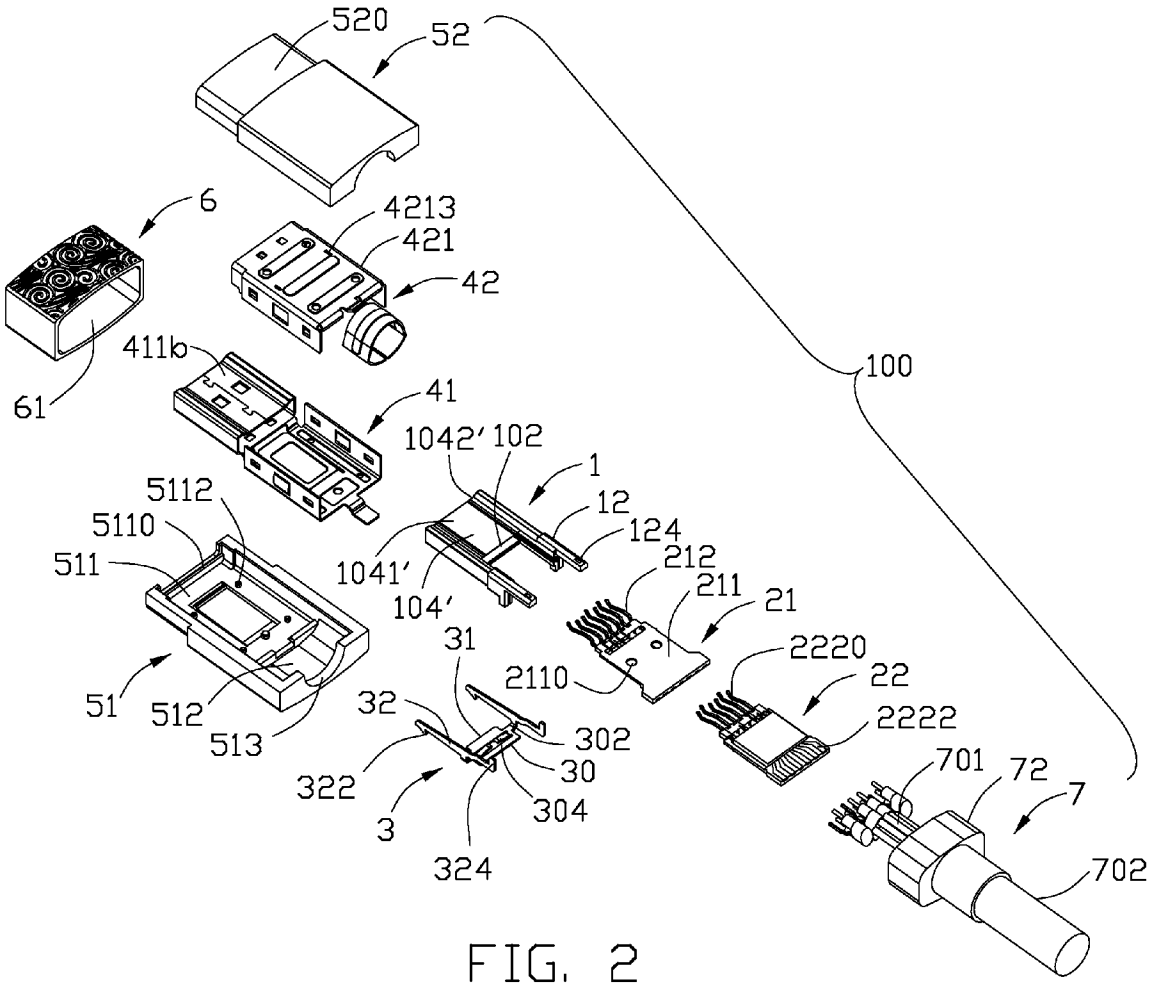
FIG. 2 is similar to FIG. 1, but viewed from another aspect.
Figure 3:
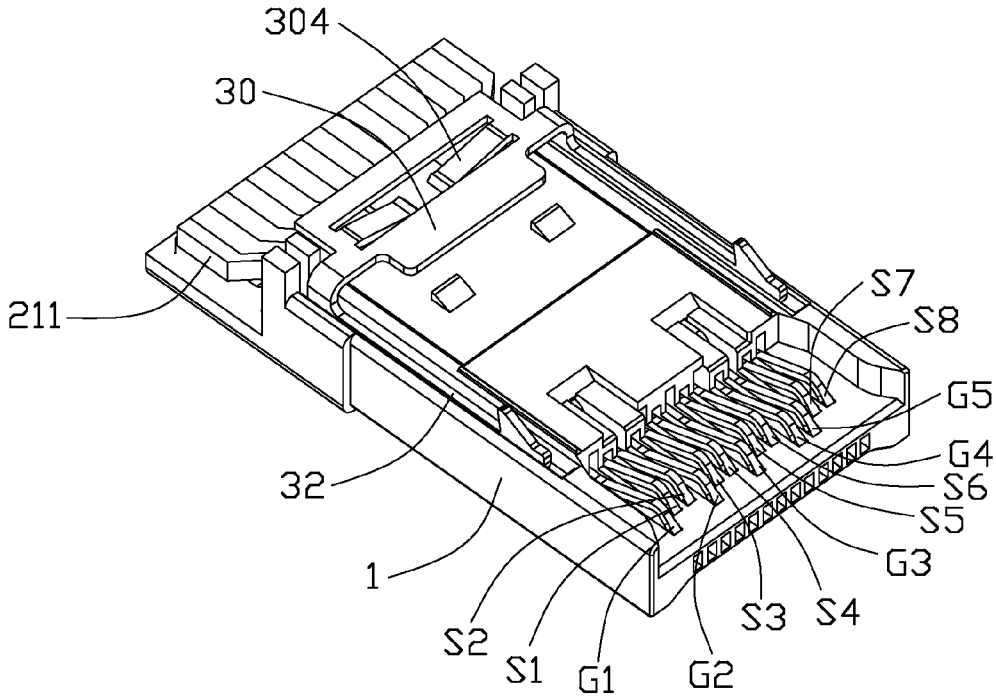
FIG. 3 is a partially assembled view of the cable assembly.
Figure 4:
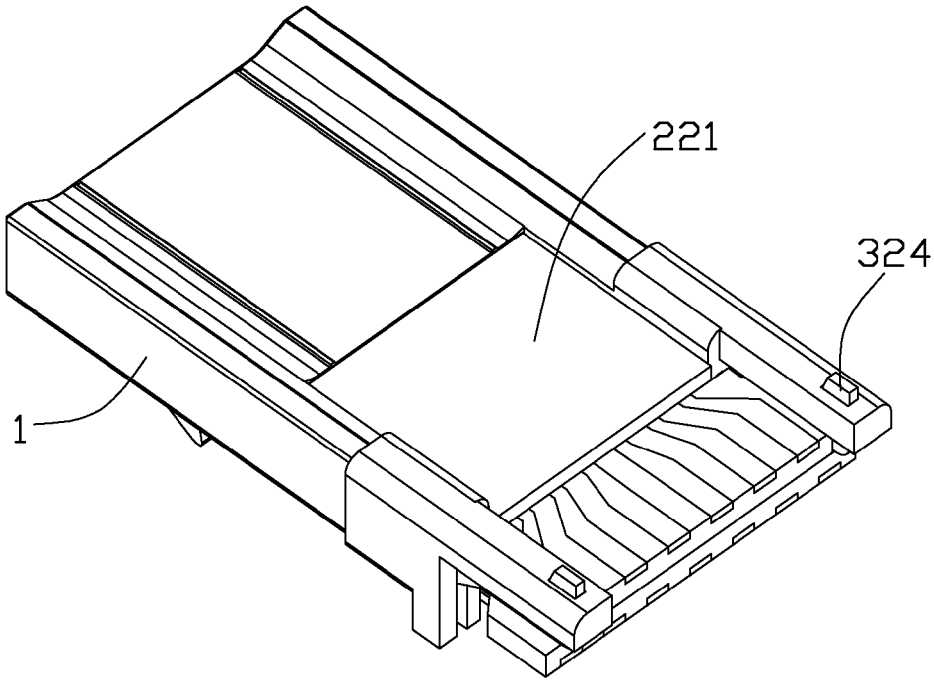
FIG. 4 is similar to FIG. 3, but viewed from other direction.
Figure 5:
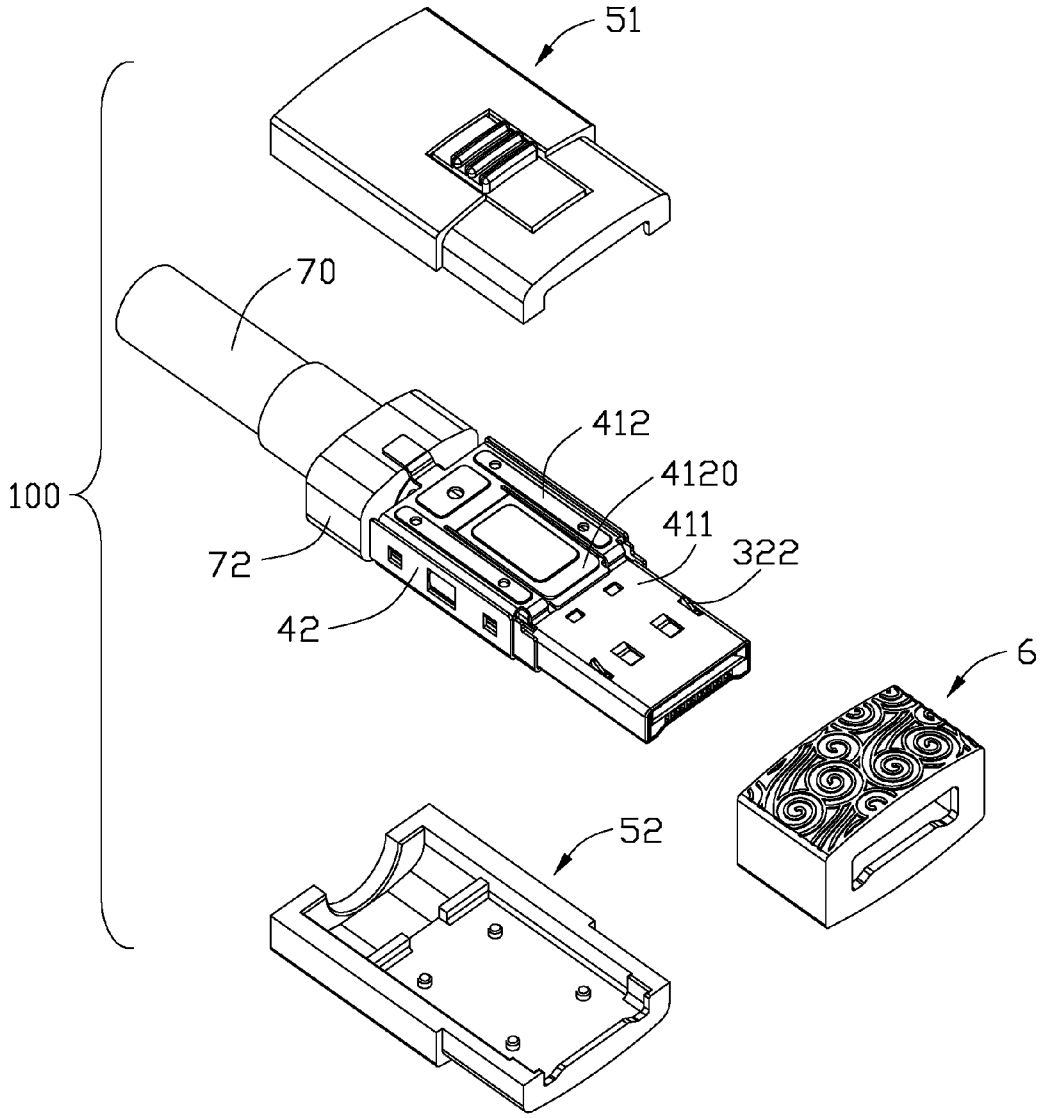
FIG. 5 is other partially assembled view of the cable assembly.
Figure 6:
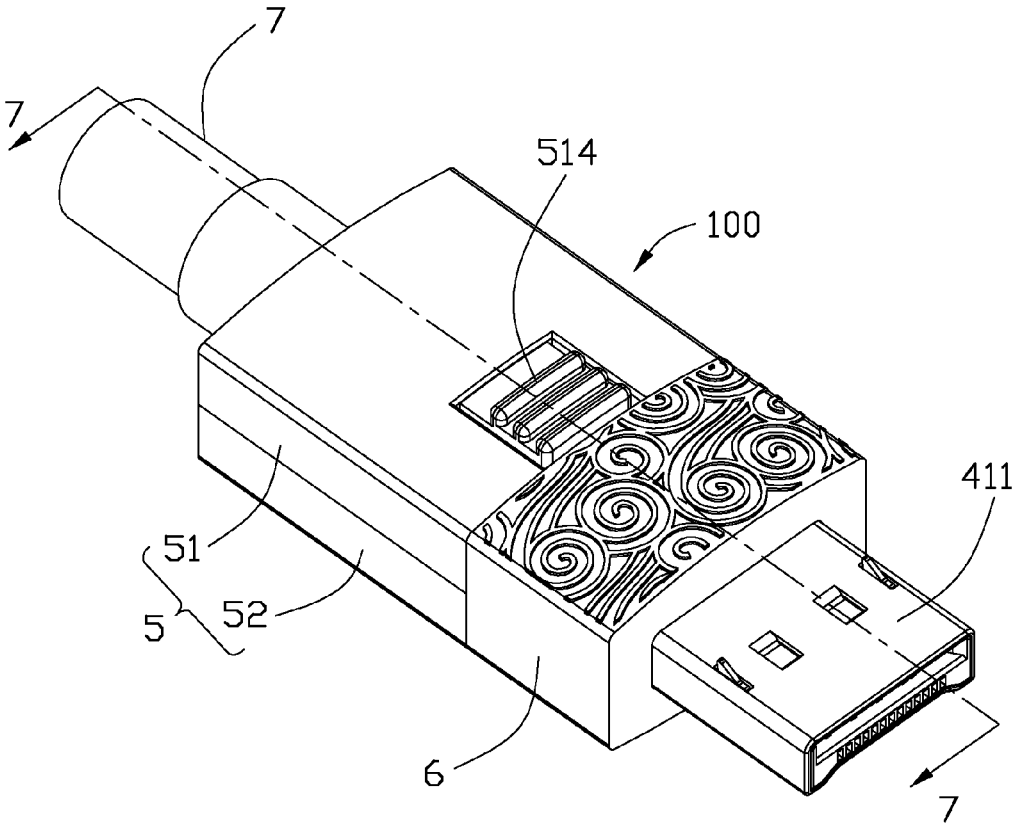
FIG. 6 is an assembled, perspective view of the cable assembly.
Figure 7:
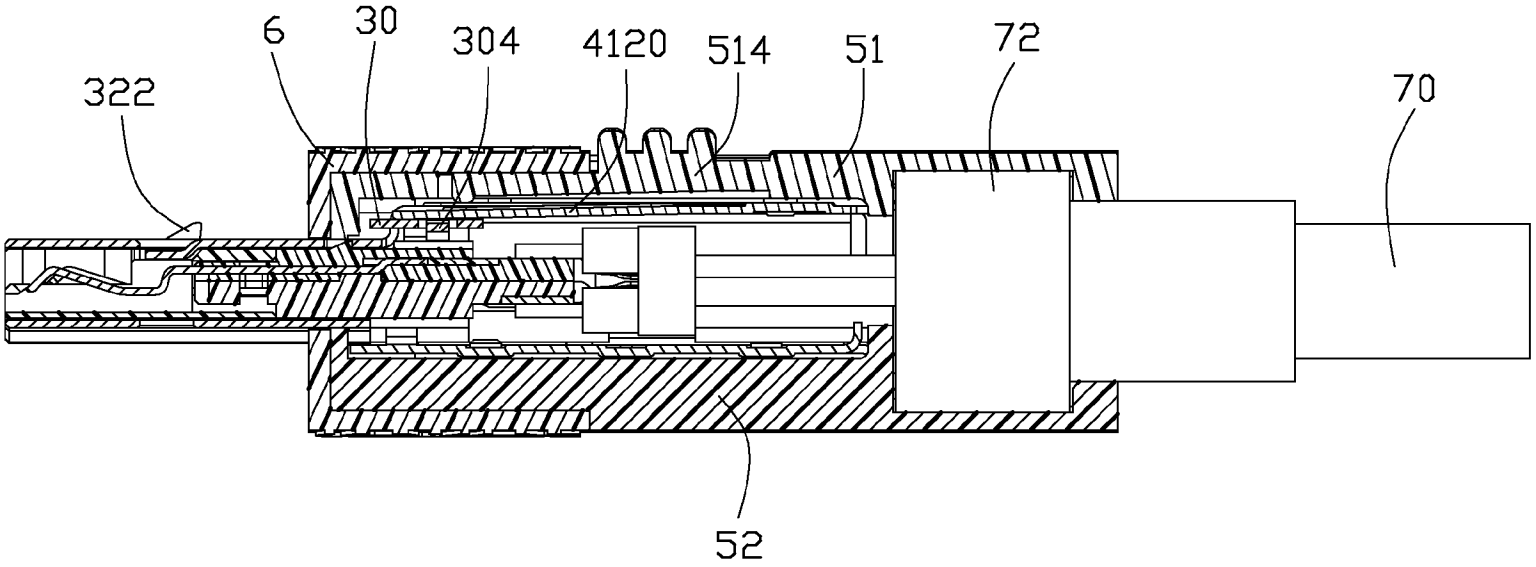
FIG. 7 is a cross-section view taken along line 7-7 of FIG. 6.
Figure 8:
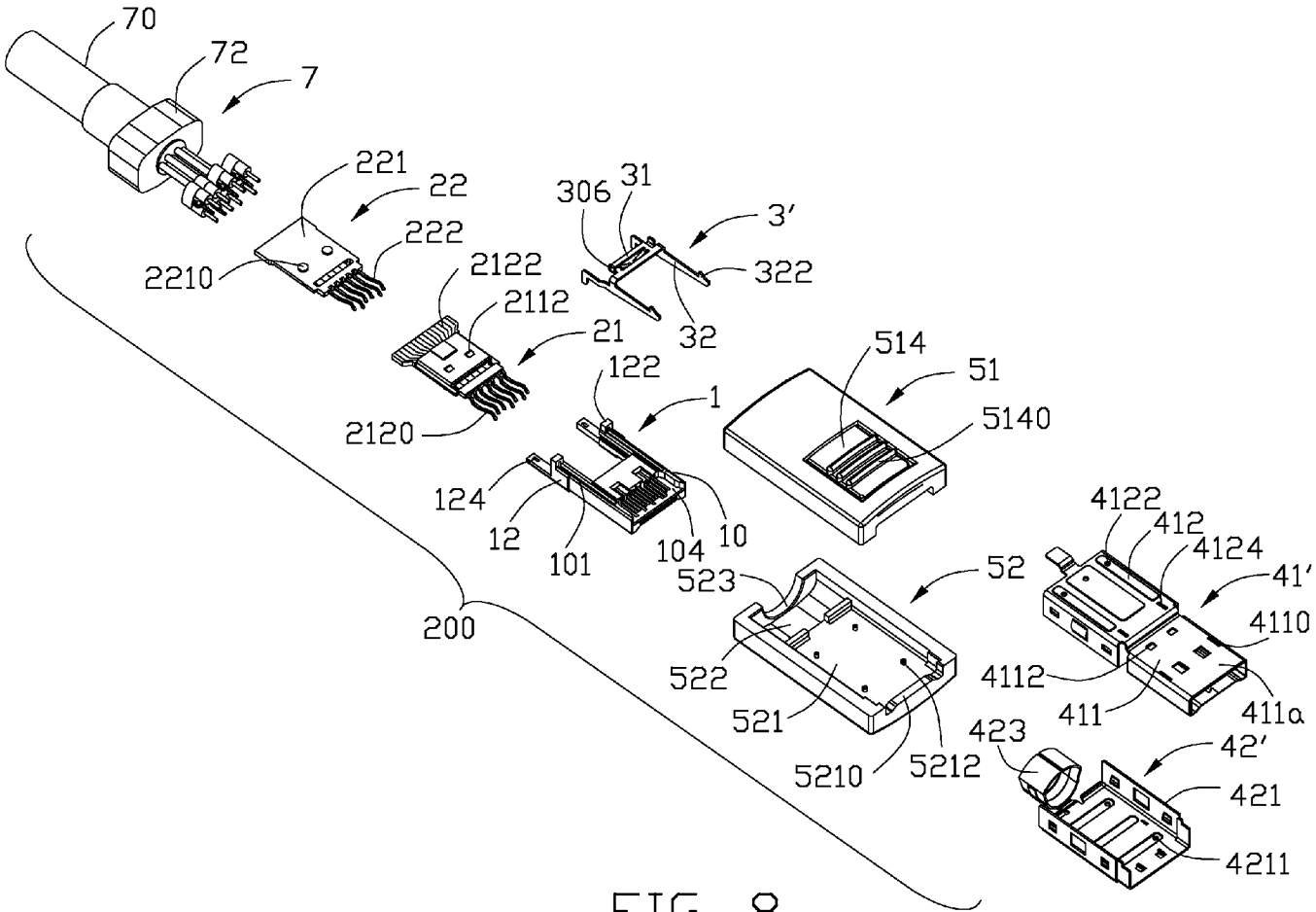
FIG. 8 is an exploded, perspective view of a cable assembly of the second embodiment in accordance with the present invention.
Figure 9:
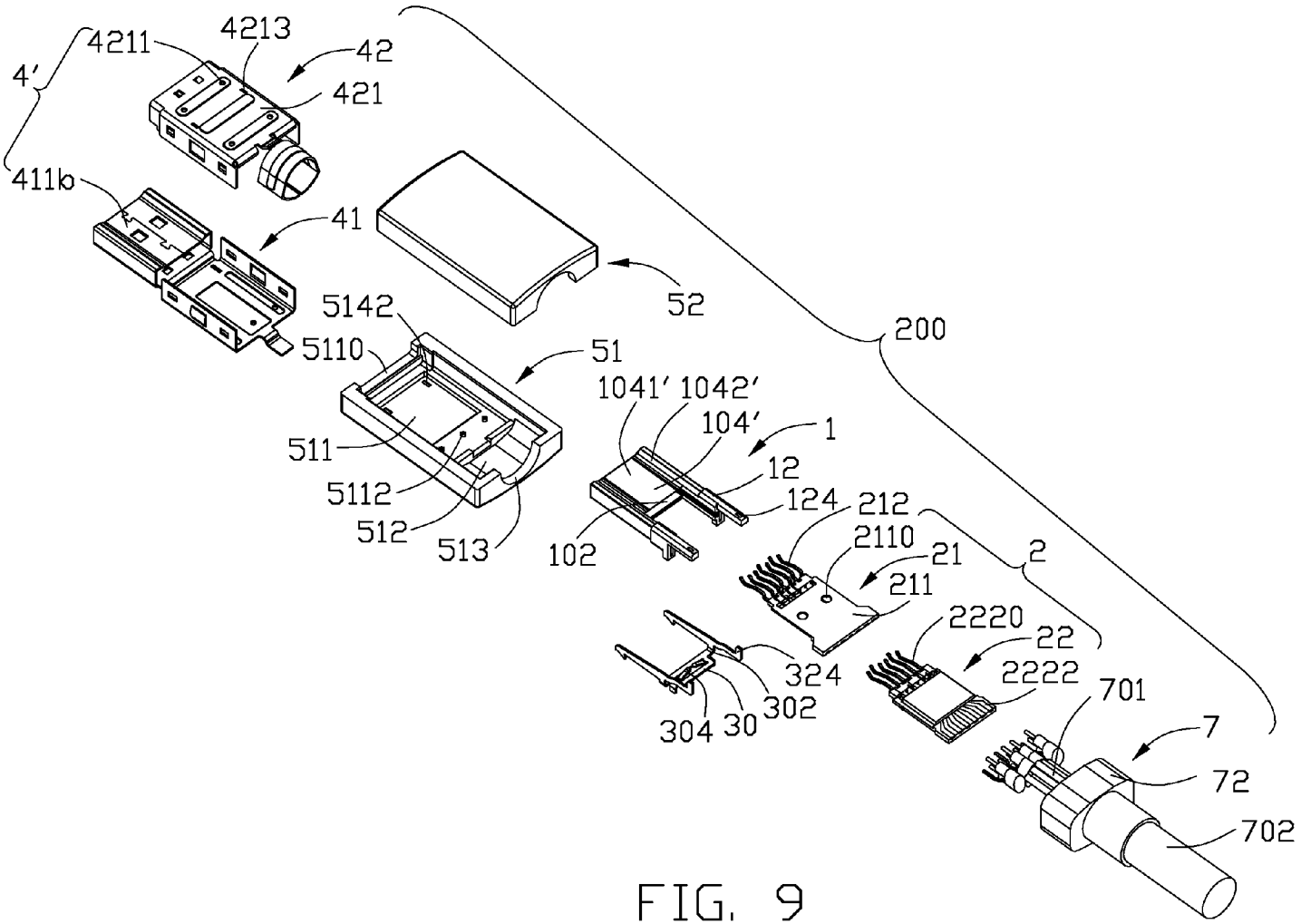
FIG. 9 is similar to FIG. 8, but viewed from another aspect.
Figure 10:
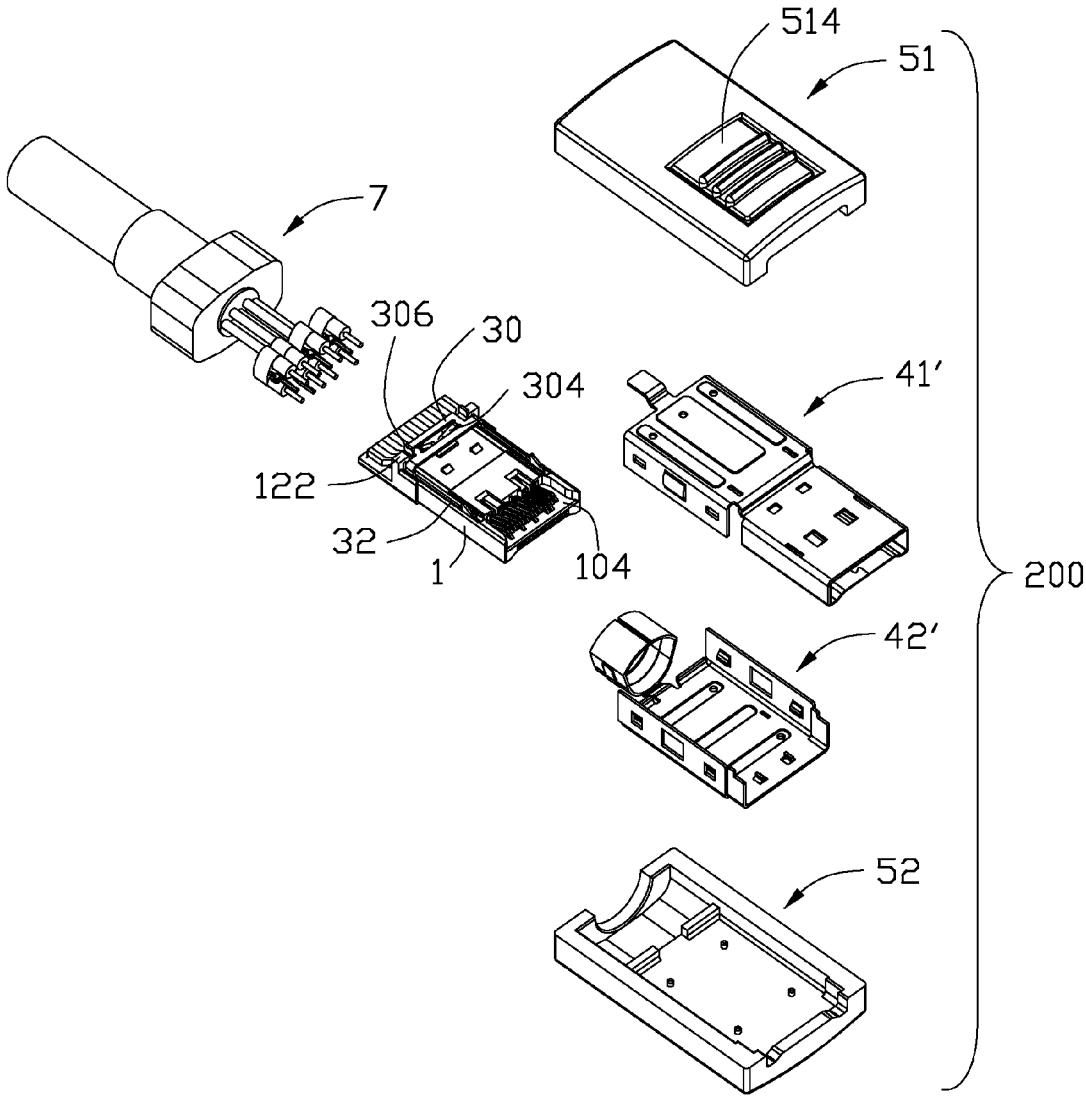
FIG. 10 is a partially assembled view of the cable assembly.
Figure 11:
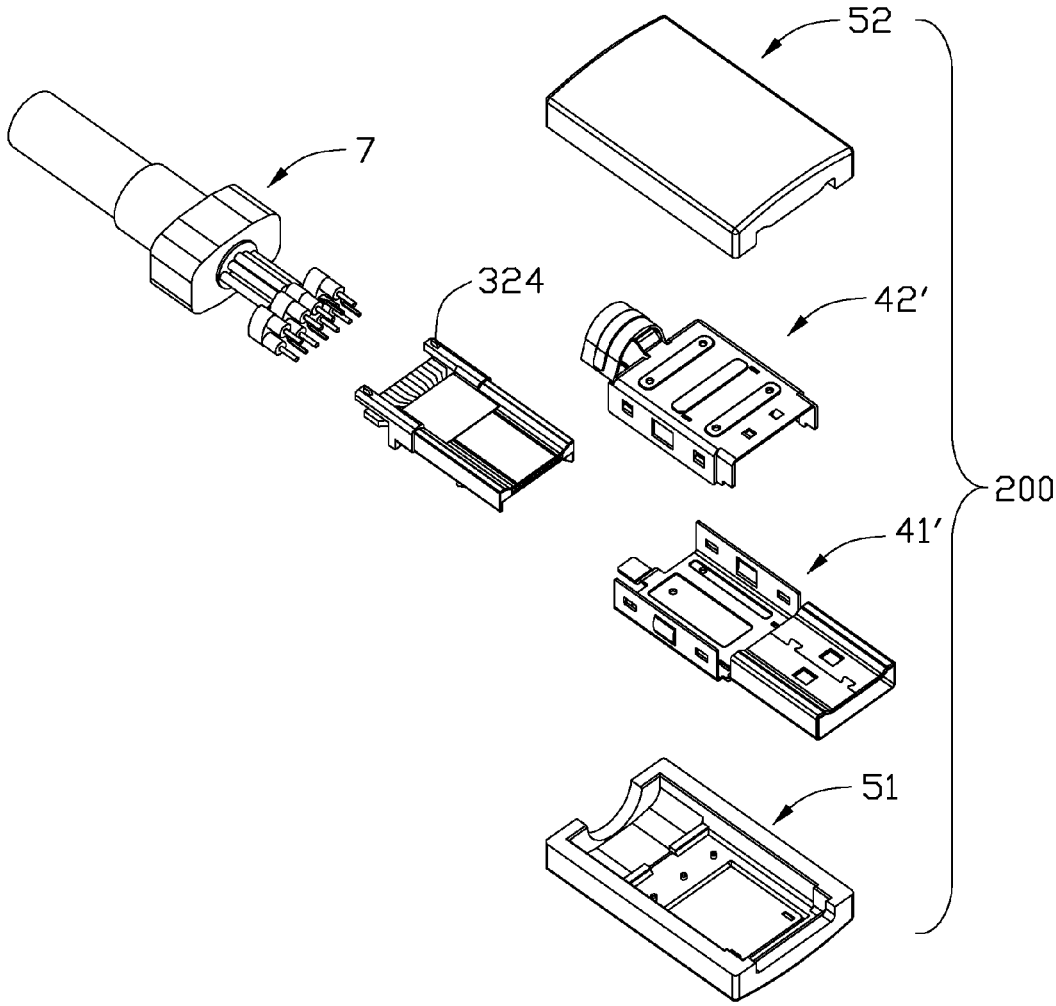
FIG. 11 is similar to FIG. 10, but viewed from other direction.
Figure 12:
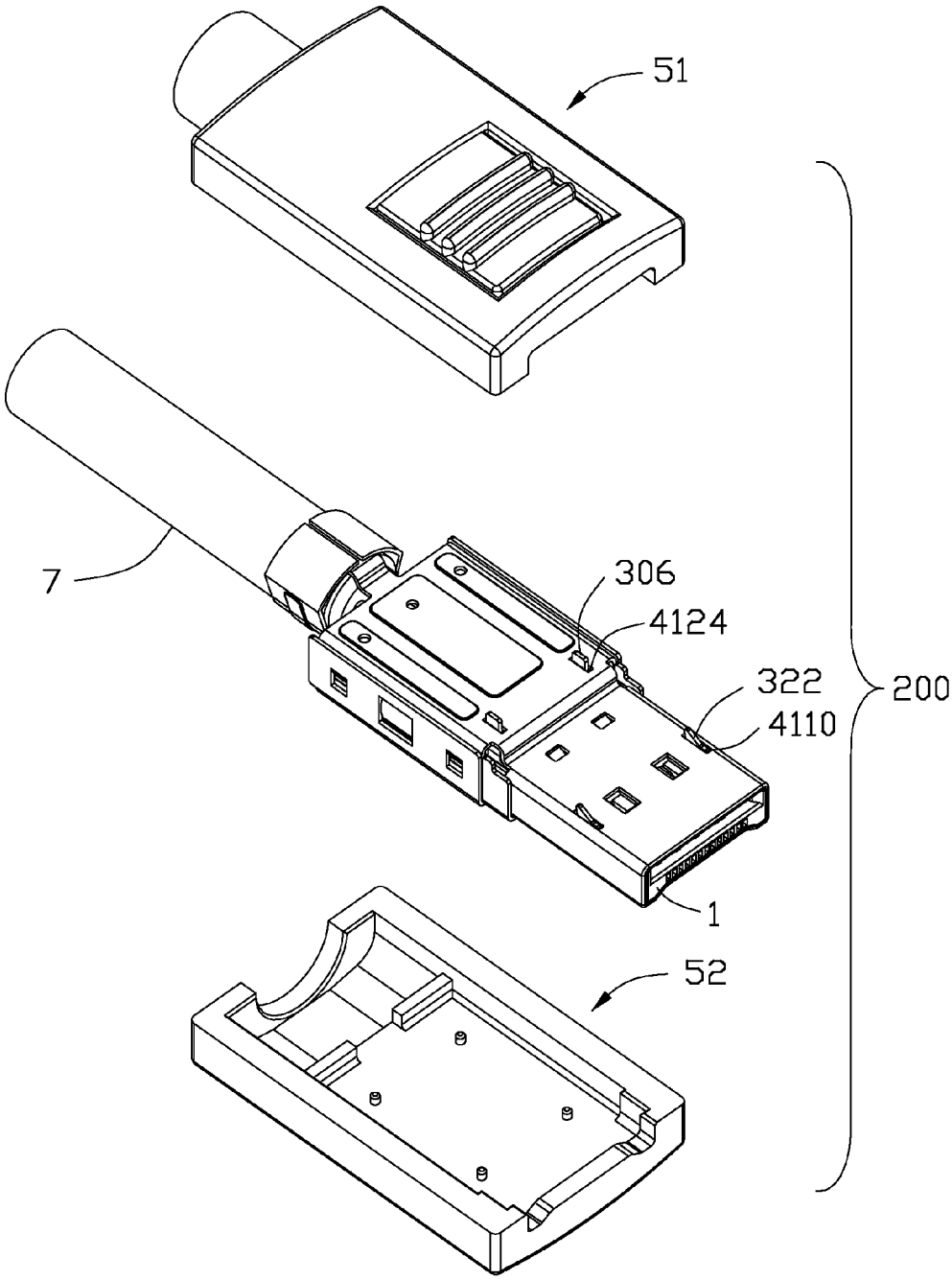
FIG. 12 is other partially assembled view of the cable assembly.
Figure 13:
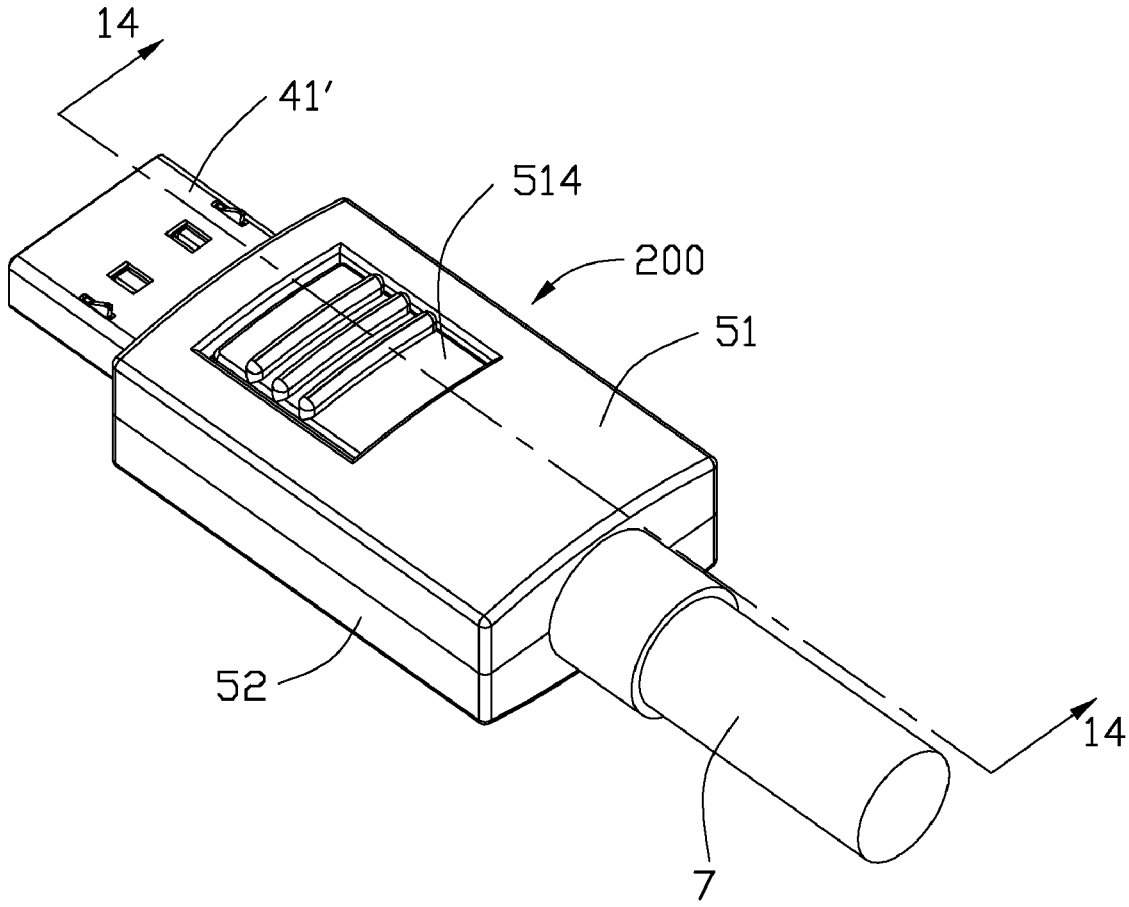
FIG. 13 is an assembled, perspective view of the cable assembly.
Figure 14:
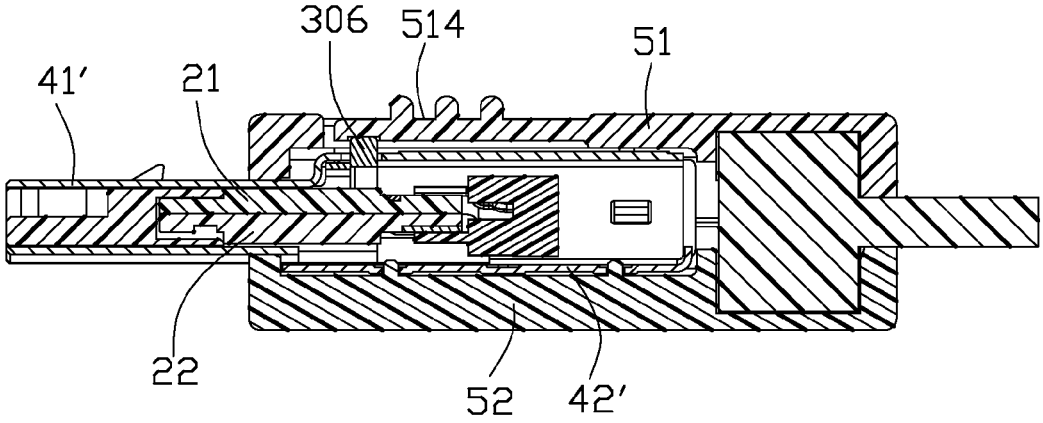
FIG. 14 is a cross-section view taken along line 14-14 of FIG. 13.

Referring to FIG. 3 in conjunction with FIGS. 1-2, the first terminal module 21 and the second terminal module 22 are assembled together, with the contacting portions 2120, 2220 merged into one row, while the tail portions 2122, 2222 separated into two distinct rows along an up-to-down direction. The mounting posts 2210 are inserted into the mounting holes 2110 so as to keep the first terminal module 21 and the second terminal module 22 together. The first terminal module 21 and the second terminal module 22 are assembled to the insulative housing 1, with front segments of the insulators 211, 221 inserted into the receiving space 102, a rear segment of the insulator 221 supported by the mounting arms 12. The signal terminals includes six signal terminals separated into three groups: S1-S2, S3-S4, S5-S6 which are respectively arranged between four grounding terminals G1, G2, G3, G4. The signal terminals S1-S2, S3-S4, S5-S6 are differential pairs which are used for transmitting video signal. Furthermore, an additional two signal terminals S7-S8 are located at right side and accompanied by a grounding terminal G5 arranged adjacent to the grounding terminal G4. The signal terminals S7-S8 are used for transmitting audio signals or other signals. The signals S2, S3, S6, S8 and the grounding terminals G1, G3, G5 which are arranged in a row and belong to the first terminal module 21, and the signals 51, S4, S5, S7 and the grounding terminals G2, G4 which are arranged in other row and belong to the second terminal module 22.

The latching member 3 includes two latching arms 32 spaced apart from each other along a transversal direction and a connecting portion 31 with two opposite ends thereof joined with the two latching arms 32. The connecting portion 31 includes a main segment 30 and two L-shaped bridge segments 302 respectively projected laterally from two opposite free ends of the main segment 30. Each L-shaped bridge segment 302 with a lower end thereof engaged with the corresponding latching arm 32 so as to raise the main segment 30. Two resilient tabs 304 are formed with and extend downwardly from the main segment 30, and the two resilient tabs 304 reach the insulator 211 so as to provide a restored force onto the latching member 3. Each latching arm 32 has an upward hook 322 formed at a front end thereof and a downward foot 324 formed at a rear end thereof.

The metallic shell 4 has a first shell 41 and a second shell 42. The first shell 41 includes a frame 411 to accommodate the main portion 10 therein and an inverted U-shaped stretching part 412 extending rearwardly from a back edge of the frame 411. Two through holes 4110 are defined in a front segment of a top side 411*a* of the frame 411 to allow hooks 322 of the latching member 3 passing through. Two holes 4112 are defined in a back segment of the top side 411*a* to engage with the two protruding portions 2112 of the insulator 211. The frame 411 has a bottom side 411*b* suitably matching with the depression 104' of the insulative housing 1. A middle segment of a top side of the stretching part 412 is cut off other portions of the top side, excepted for a back portion of the stretching 412, to form a deformable segment 4120. Four holes 4122 are divided into two groups and respectively defined in lateral portions of the top side of the stretching part 412.

The second shell 42 includes a main body 421 similar to the stretching part 412 and a cable holder 423 integrated with the main body 421 and projecting backwardly. Four holes 4211 are divided into two groups and respectively defined in lateral portions of a bottom side of the main body 421. The main body 421 and the stretching part 412 are joined together by latching means thereof. Two positioning holes 4213 are defined in lateral sides of a middle segment of the bottom side of the main body 421, and the feet 324 of the latching arms 32 can be respectively inserted into the positioning holes 4213 and further soldered to the bottom side of the main body 421.

The external cover 5 includes an upper cover 51 and a bottom cover 52. The upper cover 51 has a first hollow 511 and a second hollow 512 disposed behind the first hollow 511. A rectangular shaped opening 5110 is located in the front portion of the upper cover 51, and the opening 5110 further communicates with the first hollow 511. A semicircular shaped outlet 513 is defined in the rear portion of the upper cover 51 and communicated with the second hollow 512. Four protruding ribs 5112 are divided into two groups and formed at lateral sides of the first hollow 511 and inserted into the holes 4122 of the first shell 41. A front segment 510 of the upper cover 51 is thinner than a rear segment of the upper cover 51. A deformable button 514 is integrally formed with the upper cover 51 and floatable along up-to-down direction to enter the first hollow 511 so as to actuate the deformable segment 4120. In addition, a number of ribs 5140 are formed on a top side of the deformable button 514 to increase friction between user's thumb and the deformable button 514.

The bottom cover 52 is similar to the upper cover 51, and also has a first hollow 521 and a second hollow 522 disposed behind the first hollow 521. An opening 5210 is located in the front portion of the bottom cover 52, and the opening 5210 further communicates with the first hollow 521. A semicircular shaped outlet 523 is defined in the rear portion of the bottom cover 52 and communicated with the second hollow 522. Four protruding ribs 5212 are divided into two groups and formed at lateral sides of the first hollow 521 and inserted into the holes 4211 of the second shell 42. A front segment 520 of the bottom cover 52 is thinner than a rear segment of the bottom cover 52.

The cap 6 has a number of sides (not numbered) joined together to enclose a roomage 61 with a front opening 62. The front segments 510, 520 are accommodated in the roomage 61 of the cap 6, with the frame 411 of the first shell 41 protruding outward via the front opening 62.

The cable 7 includes a cable member 70 and insulative block 72 attached to a front segment of the cable member 70. The cable member 70 further has a number of wires 701 shielded by a jacket 702. The insulative block 72 is overmolded onto the jacket 702, and the wires 701 are soldered to the tail portions 2122, 2222 of the terminals 212, 222. The insulative block 72 is retained in the second hollows 512, 522. Furthermore, partial of wires 701 adjacent to the terminals is shielded by the metallic shell 4, therefore, a connecting area between the terminals 212, 222 and the wires 701 is well shielded and protected.

When detach the cable assembly 100 from a complementary connector, just press the deformable button 514 to actuate the deformable segment 4120 and urge the connecting portion 31 of the latching member 3 downwardly movement, and the latching arms 32 retreat into the slots 101. When the pressing force is withdrawn, the deformable button 514 and the deformable segment 4120 restored to their original positions, and the latching arms 32 also upwardly movement by rebounded force of the resilient tabs 304.

The deformable button 514 may directly contact the connecting portion 31, the terminals 212, 222 mounted to the insulative housing 1, and the resilient tabs 304 press onto the insulative housing 1.

Referring to FIGS. 8-14, a cable assembly 200 of the second embodiment in accordance with the present invention is disclosed, and the cable assembly 200 has an insulative housing 1, a terminal module 2, an external cover 5 and a cable 7, and all of which are similar to corresponding elements of the cable assembly 100, detailed description is omitted hereby. In addition, the cable assembly 200 also has a latching member 3' and a metallic shell 4', and both of them are similar to the latching member 3 and the metallic shell 4.

The latching member 3' includes two latching arms 32 spaced apart from each other along a transversal direction and a connecting portion 31 with two opposite ends thereof joined with the two latching arms 32. The connecting portion 31 includes a main segment 30 and two L-shaped bridge segments 302 respectively projected laterally from two opposite free ends of the main segment 30. Each L-shaped bridge segment 302 with a lower end thereof engaged with the corresponding latching arm 32 so as to raise the main segment 30. Two resilient tabs 304 are formed with and extend downwardly from the main segment 30, and the two resilient tabs 304 reach the insulator 211 so as to provide a restored force onto the latching member 3. Each latching arm 32 has an upward hook 322 formed at a front end thereof and a downward foot 324 formed at a rear end thereof. Furthermore, two tabs 306 project upwardly from lateral edges of the main segment 30 of the connecting portion 31.

The metallic shell 4' has a first shell 41' and a second shell 42'. The second 42' is the same with the second shell 42 of the cable assembly 100, and the first shell 41' is similar to the first shell 41 of the cable assembly 100.

The first shell 41' includes a frame 411 and an inverted U-shaped stretching part 412 extending rearwardly from a back edge of the frame 411. Two through holes 4110 are defined in a front segment of a top side 411*a* of the frame 411 to allow hooks 322 of the latching member 3 passing through. Two holes 4112 are defined in a back segment of the top side 411*a* to engage with the two protruding portions 2112 of the insulator 211. Two slots 4124 are defined in front segment of a top side of the stretching part 412. The tabs 306 of the latching member 3' protrudes outwardly via the two slots 4124 and disposed adjacent to a deformable button 514, and the deformable button 514 is pressed to actuate the tabs 306, and to urge the latching arms 32 moving into slots 101 of the insulative housing 1.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing with a plurality of terminals;

a cable having a plurality of wires respectively connected to the plurality of terminals;

a latching member mounted to the insulative housing, the latching member including two latching arms spaced apart from each other along a transversal direction and a connecting portion with two opposite ends thereof joined with the two latching arms, at least one resilient tab extending downwardly from the connecting portion; and an external cover enclosing the insulative housing and the latching member, the external cover having a deformable button disposed proximate to the connecting portion of the latching member;

the insulating housing includes a main portion and two mounting arms extending rearwardly from lateral sides of the main portion; a receiving space is recessed forwardly from a middle segment of a rear edge of the main portion, a cavity is recessed downwardly from a front segment of a top side of the main portion and further communicates with the receiving space; a depression is defined in a lower side of the main portion, and the depression is of isosceles trapezoid shape, which has a horizontal side and two oblique sides, a slot is defined in the mounting arm and partial of main portion in front of the mounting arm; a positioning hole is defined in a rear portion of the mounting arm, and a standoff is formed on middle portion of the mounting arm and projected upwardly;

part of a middle segment of a top side of the metallic shell is configured to be a deformable segment, the deformable segment is arranged between the connecting portion of the latching member and the deformable button of the external cover.

2. The cable assembly as recited in claim 1, wherein the external cover includes an upper cover and a bottom cover, and a cap mounted to front segments of the upper cover and the bottom cover.

3. The cable assembly as recited in claim 1, wherein the connecting portion includes a main segment and two L-shaped bridge segments respectively projecting laterally from two opposite free ends of the main segment.

4. The cable assembly as recited in claim 3, wherein the at least one resilient tab is integrally formed with the main segment.

5. The cable assembly as recited in claim 3, wherein the two L-shaped bridge segments are respectively connected to top edges of the two latching arms.

6. The cable assembly as recited in claim 1, wherein; the plurality of terminals comprising signal terminals and ground terminal.

7. The cable assembly as recited in claim 6, wherein each latching arm has a downward foot formed at a rear end thereof and inserted into the positioning hole.

8. The cable assembly as recited in claim 7, wherein a metallic shell shields the insulative housing and the latching member.

9. The cable assembly as recited in claim 8, wherein the positioning hole is defined in a top side of the metallic shell and the foot of the latching arm passes through the positioning hole and soldered to the metal shell.

10. The cable assembly as recited in claim 8, wherein the signal terminals are differential signal pairs.

11. The cable assembly as recited in claim 1, wherein the terminals are divided into two rows and respectively combined with a corresponding insulator to form a first terminal module and a second terminal module.

12. The cable assembly as recited in claim 11, wherein the at least one resilient tab reaches the insulator of the first terminal module.

13. The cable assembly as recited in claim 11, wherein the first terminal module and the second terminal module overlap each other, with contacting portions of the terminals of the first terminal module and contacting portions of the terminals of the second terminal module merged into a row along the transversal direction.

14. The cable assembly as recited in claim 13, wherein a cavity is recessed downwardly from a front segment of a top side of the insulative housing, and the contacting portions of the terminals are accommodated in the cavity.

15. A connector for connecting with a cable, comprising:

an insulative housing with a plurality of terminals;

a latching member mounted to the insulative housing, the latching member including two latching arms spaced apart from each other along a transversal direction and a connecting portion with two opposite ends thereof joined with the two latching arms, at least one resilient tab extending downwardly from the connecting portion, and at least one tab projecting upwardly from connecting portion;

a metallic shell shielding the terminals and the latch member therein, with the at least one tab protruding outward of the metal shell via a corresponding slot defined in a top side thereof;

an external cover enclosing the insulative housing and the latching member, the external cover having a deformable button disposed above the at least one tab of the latching member;

the insulating housing includes a main portion and two mounting arms extending rearwardly from lateral sides of the main portion; a receiving space is recessed forwardly from a middle segment of a rear edge of the main portion, a cavity is recessed downwardly from a front segment of a top side of the main portion and further communicates with the receiving space; a depression is defined in a lower side of the main portion, and the depression is of isosceles trapezoid shape, which has a horizontal side and two oblique sides, a slot is defined in the mounting arm and partial of main portion in front of the mounting arm; a positioning hole is defined in a rear portion of the mounting arm, and a standoff is formed on middle portion of the mounting arm and projected upwardly;

part of a middle segment of a top side of the metallic shell is configured to be a deformable segment, the deformable segment is arranged between the connecting portion of the latching member and the deformable button of the external cover.

16. The connector as recited in claim 15, wherein the terminals includes six signal terminals divided into three differential pairs and spaced apart from each other by four grounding terminals.

17. The connector as recited in claim 15, wherein the cable has a plurality of wires connected to the terminals and part of the wires adjacent to the terminals is shielded by the metallic shell.

18. An electrical cable connector comprising:

an insulative housing;

a latching member mounted upon the housing and including a pair of latching arms connected with each other via a connecting portion therebeween in a transverse direction;

a metallic shell enclosing the housing with two slits to expose corresponding hooks of said latching arms, respectively, in a vertical direction perpendicular to said transverse direction; and an insulative cover covering the shell; wherein said connecting portion is equipped unitarily with a resilient portion to urge the pair of latching arms to move outwardly in said vertical direction, and said cover is equipped unitarily with a deformable button to abut against said connecting portion inwardly in said vertical direction during pressing said deformable button; wherein a first terminal module includes a first insulator and a first set of terminals combined together by insert-molded process; the first set of terminals are divided into signal terminals and grounding terminals configured to be longer than the signal terminals; the first set of terminals have contacting portions disposed in front of an edge of the first insulator and tail portions located on a back segment of the first insulator and fanned out;

the second terminal module is stacked with the first terminal module, and includes a second insulator and a second set of terminals combined together by insert-molded process; the second set of terminals are divided into signal terminals and grounding terminals configured to be longer than the signal terminals; the second set of terminals have contacting portions disposed in front of an edge of the second insulator and tail portions located on a back segment of the second insulator and fanned out wherein the contacting portion of the first set of terminals and the contacting portions of the second set of terminals are intermixed in one row.

19. The electrical cable connector as claimed in claim 18, wherein said latching member is equipped with at least one tab for engagement with the deformable button in said vertical direction.

* * * * *